US009358666B2

(12) United States Patent
Bae et al.

(10) Patent No.: US 9,358,666 B2
(45) Date of Patent: Jun. 7, 2016

(54) SLURRY SUPPLY DEVICE AND POLISHING APPARATUS INCLUDING THE SAME

(71) Applicant: LG SILTRON INCORPORATED, Gumi-si, Gyeongsangbuk-do (KR)

(72) Inventors: Jae Hyun Bae, Gumi-si (KR); Kee Yun Han, Gumi-si (KR)

(73) Assignee: LG SILTRON INCORPORATED, Gumi-Si (KR)

( * ) Notice: Subject to any disclaimer, the term of this patent is extended or adjusted under 35 U.S.C. 154(b) by 9 days.

(21) Appl. No.: 14/571,492

(22) Filed: Dec. 16, 2014

(65) Prior Publication Data

US 2016/0045999 A1 Feb. 18, 2016

(30) Foreign Application Priority Data

Aug. 13, 2014 (KR) ..... 10-2014-0105105

(51) Int. Cl.
*B24B 57/00* (2006.01)
*B24B 57/02* (2006.01)
*B24B 53/017* (2012.01)

(52) U.S. Cl.
CPC ..... *B24B 57/02* (2013.01); *B24B 53/017* (2013.01)

(58) Field of Classification Search
CPC ..... B24B 57/02; B24B 57/00; B24B 37/04; B24B 1/04; B24B 53/017; B24B 7/17
USPC ..... 451/60.446, 262
See application file for complete search history.

(56) References Cited

U.S. PATENT DOCUMENTS 3,978,621 A * 9/1976 Janssen ..... B24B 57/00 451/262
5,109,631 A * 5/1992 Biebesheimer ..... B24B 57/02 451/1
5,941,759 A * 8/1999 Kitajima ..... B24B 37/28 257/E21.237
5,945,346 A * 8/1999 Vanell ..... B24B 51/00 438/691
6,045,437 A * 4/2000 Tandon ..... B24B 57/02 451/288

(Continued)

FOREIGN PATENT DOCUMENTS

DE 100 60 697 A1 6/2002
JP S56-158274 A 12/1981

(Continued)

OTHER PUBLICATIONS

Korean Office Action dated Oct. 28, 2015 issued in Application No. 10-2014-0105105.

(Continued)

*Primary Examiner* — George Nguyen
(74) *Attorney, Agent, or Firm* — KED & Associates, LLP

(57) ABSTRACT

Disclosed is a slurry supply device including a nozzle configured to eject slurry, a slurry supply unit configured to receive the slurry from the nozzle and to discharge the slurry through at least one slurry hole, a receiving unit configured to allow the slurry supply unit to be mounted, inserted, seated, coupled, supported, or placed therein so as to enable discharge of the slurry from the slurry supply unit, the receiving unit being configured to receive a flowing material around the slurry supply unit and a slurry protection unit configured to enclose a space for passage of the slurry from an exit of the nozzle to an entrance of the slurry supply unit in conjunction with the flowing material.

20 Claims, 12 Drawing Sheets

(56) References Cited

U.S. PATENT DOCUMENTS 6,099,393 A * 8/2000 Katagiri ..... B24B 53/013 451/444
6,113,490 A * 9/2000 Hakomori ..... B24B 37/08 257/E21.23
6,159,082 A * 12/2000 Sugiyama ..... B24B 57/02 451/285
6,334,810 B1 * 1/2002 Song ..... B24B 53/017 451/60
6,733,368 B1 * 5/2004 Pan ..... B24B 37/042 451/177
7,338,352 B2 * 3/2008 Seong ..... B01F 5/0256 451/446
7,485,029 B2 * 2/2009 Kanda ..... B24B 37/08 451/262
7,651,384 B2 * 1/2010 Golden ..... B23H 5/08 451/41
7,727,053 B2 * 6/2010 Ueno ..... B24B 37/08 451/262
2001/0010305 A1 * 8/2001 Takahashi ..... B24B 37/04 216/89
2002/0115387 A1 8/2002 Wenski et al.
2004/0127143 A1 * 7/2004 Kim ..... B24B 57/02 451/5
2008/0227371 A1 * 9/2008 Onishi ..... B24B 37/013 451/262

FOREIGN PATENT DOCUMENTS

JP 2002-217138 A 8/2002
JP 2005-230978 A 9/2005

OTHER PUBLICATIONS

Japanese Office Action issued in Application No. 2014-227733 dated Jun. 9, 2015.

* cited by examiner

SLURRY SUPPLY DEVICE AND POLISHING APPARATUS INCLUDING THE SAME

CROSS REFERENCE TO RELATED APPLICATION

This application claims priority under 35 U.S.C. §119 to Korean Patent Application No. 10-2014-0105105, filed in Korea on 13 Aug. 2014, which are hereby incorporated in their entireties by reference as if fully set forth herein.

TECHNICAL FIELD

Embodiments relate to slurry supply device and polishing apparatus including the same.

BACKGROUND

Due to higher integration of semiconductor devices, scratches or defects of semiconductor wafers, caused upon lapping or chemical-mechanical double side polishing (DSP) among wafer manufacturing processes, have been recognized as an important factor having a great effect on the yield and productivity of semiconductor devices. In particular, in the case of recent processes of manufacturing semiconductor devices using large-diameter wafers (e.g., wafers having a diameter of 300 mm), wafers, lapping plates, polishing heads, polishing pads and the like are being increased in size and precision.

Slurry is used in conventional lapping or double side polishing. In the case of conventional slurry supply devices, when slurry is supplied from a nozzle (not shown) to a slurry ring (not shown), contaminants, such as dust, metal or the like, may be attached to the slurry, thereby causing the slurry to be adhered to an inner slurry pipe of an upper plate or causing contamination of or damage to an object to be polished.

SUMMARY

Embodiments provide slurry supply device capable of preventing contamination of slurry and polishing apparatus including the same.

According to one embodiment, a slurry supply device includes a nozzle configured to eject slurry, a slurry supply unit configured to receive the slurry from the nozzle and to discharge the slurry through at least one slurry hole, a receiving unit configured to allow the slurry supply unit to be mounted, inserted, seated, coupled, supported, or placed therein so as to enable discharge of the slurry from the slurry supply unit, the receiving unit being configured to receive a flowing material around the slurry supply unit and a slurry protection unit configured to enclose a space for passage of the slurry from an exit of the nozzle to an entrance of the slurry supply unit in conjunction with the flowing material.

The slurry protection unit may include a nozzle receiving recess arranged to face an entrance of the slurry supply unit, the nozzle receiving recess being configured to allow the nozzle to be mounted, seated, inserted, or coupled therein and a main cover configured to hermetically seal the space for passage of the slurry in conjunction with the flowing material.

The main cover may include an upper end portion and a first sidewall portion extending from the upper end portion.

The upper end portion may extend in a first direction, the first sidewall portion may extend in a second direction, and the second direction may be a discharge direction of the slurry and is perpendicular to the first direction.

The upper end portion may have a first radius of curvature and the first sidewall portion has a second radius of curvature. The first and second radii of curvature may be the same or different.

Each of the upper end portion and the first sidewall portion may be tapered and integrally formed with each other.

The main cover may have an end submerged in the flowing material or spaced apart from the flowing material.

The main cover may further include an auxiliary cover protruding from the first sidewall portion in the first direction to cover the top of the flowing material.

The nozzle and the slurry protection unit may be fixed, and the slurry supply unit and the receiving unit may be rotatable.

Each of the slurry supply unit, the slurry protection unit, and the receiving unit may have the same plan shape. Each of the slurry supply unit, the slurry protection unit, and the receiving unit may have an annular plan shape.

The flowing material may include ultra-pure water.

The receiving unit may include a bottom portion and a second sidewall portion extending from the bottom portion to define a space configured to receive the flowing material therein.

The bottom portion may include a supply unit receiving recess configured to allow the slurry supply unit to be mounted, inserted, seated, coupled, supported, or placed therein and a through-hole for outflow of the slurry discharged from the slurry hole.

The supply unit receiving recess may have a depth less than a difference between a height of the slurry supply unit and a height of the flowing material.

The slurry supply unit may be screwed to the supply unit receiving recess.

The second sidewall portion may be spaced apart from the first sidewall portion.

The receiving unit may further include an overflow prevention portion inwardly protruding and extending from the second sidewall portion of the receiving unit so as to cover at least a portion of a surface of the flowing material.

The slurry supply device may further include a first reservoir configured to store a supplement flowing material and a first pipe configured to define a pathway for passage of the supplement flowing material from the first reservoir to the receiving unit.

The slurry supply device may further include a measurement unit configured to measure the amount of flowing material received in the receiving unit, a valve controller configured to generate a control signal based on the received amount of flowing material and a first valve configured to adjust the amount of supplement flowing material to be supplied from the first reservoir to the receiving unit in response to the control signal.

The slurry supply device may further include a second reservoir configured to store washing solution and a second pipe configured to define a pathway for passage of the washing solution from the second reservoir to the receiving unit.

The slurry supply device may further include a second valve configured to adjust the amount of washing solution to be supplied from the second reservoir to the receiving unit.

According to another embodiment, a polishing apparatus includes an upper plate and a lower plate configured to polish an upper surface and a lower surface of an object to be polished, a drive unit configured to rotate the upper plate and the slurry supply device according to any one of claims 1 to 20.

At least one of the first reservoir or the second reservoir may be mounted, seated, placed, supported or coupled to the upper plate so as to be rotated along with the upper plate.

BRIEF DESCRIPTION OF THE DRAWINGS

Arrangements and embodiments may be described in detail with reference to the following drawings in which like reference numerals refer to like elements and wherein.

DESCRIPTION OF SPECIFIC EMBODIMENTS

Hereinafter, embodiments will be described in detail with reference to the accompanying drawings in the best manner to improve understanding of the embodiments. However, various modifications of the embodiments are possible, and the technical sprit of the embodiments is not constructed as being limited to the embodiments. The embodiments of the present disclosure are provided to explain the disclosure to those skilled in the art.

Hereinafter, slurry supply device according to the embodiments will be described with reference to the accompanying drawings.

Figure 1:
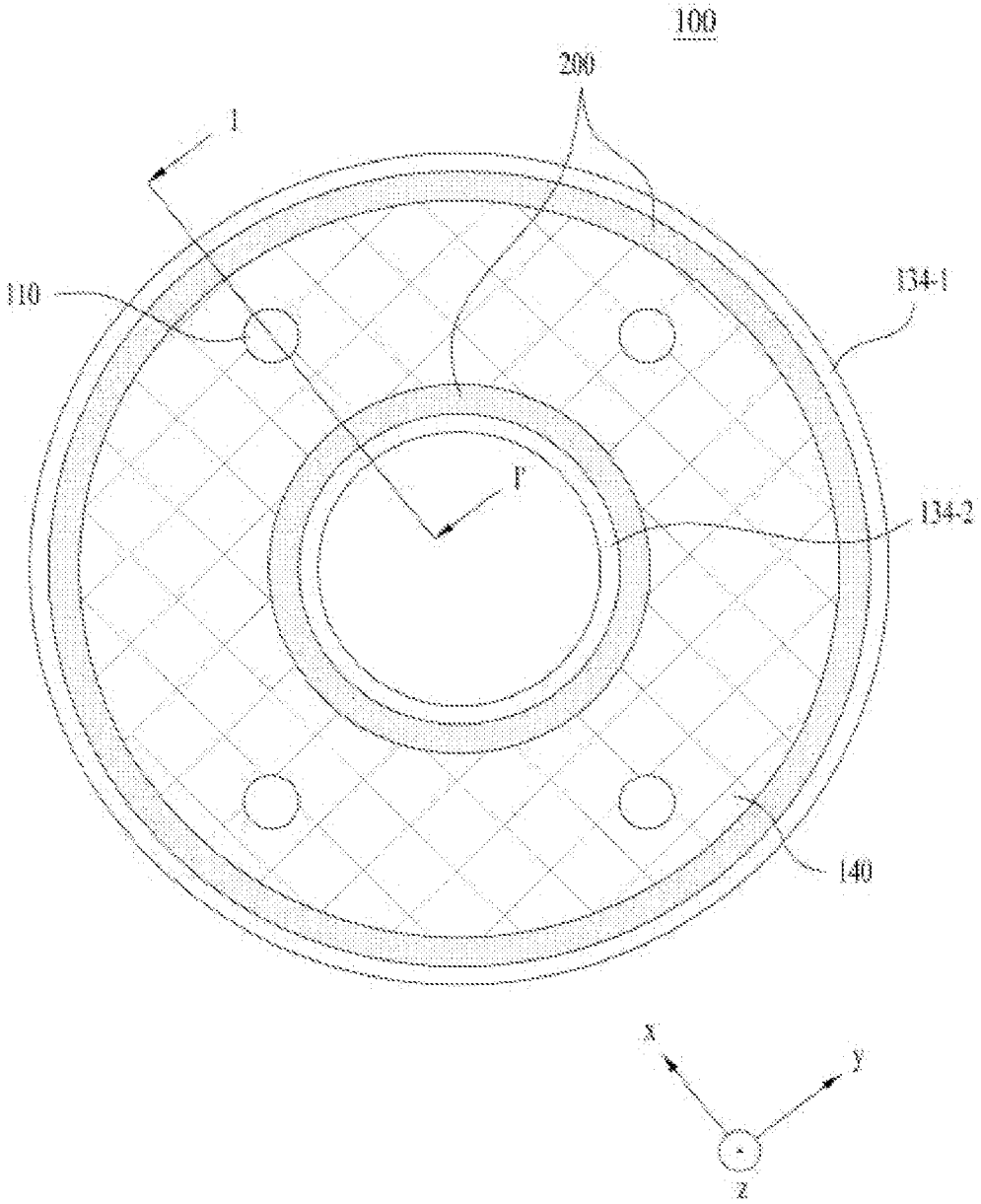
FIG. 1 is a plan view showing a slurry supply device according to an embodiment.
Figure 2A:
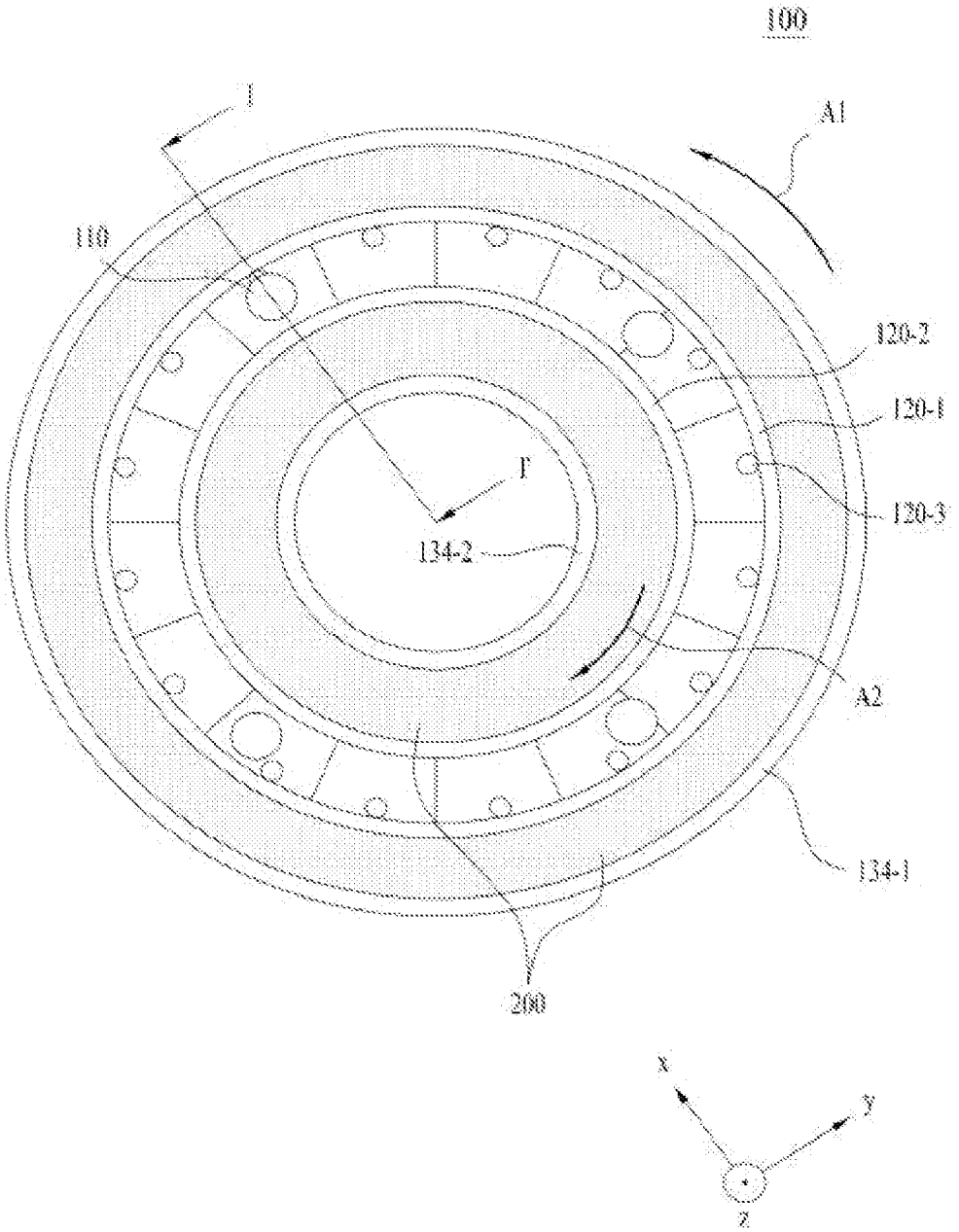
FIG. 2A is a plan view showing the slurry supply device shown in FIG. 1 without a slurry protection unit.
Figure 2B:
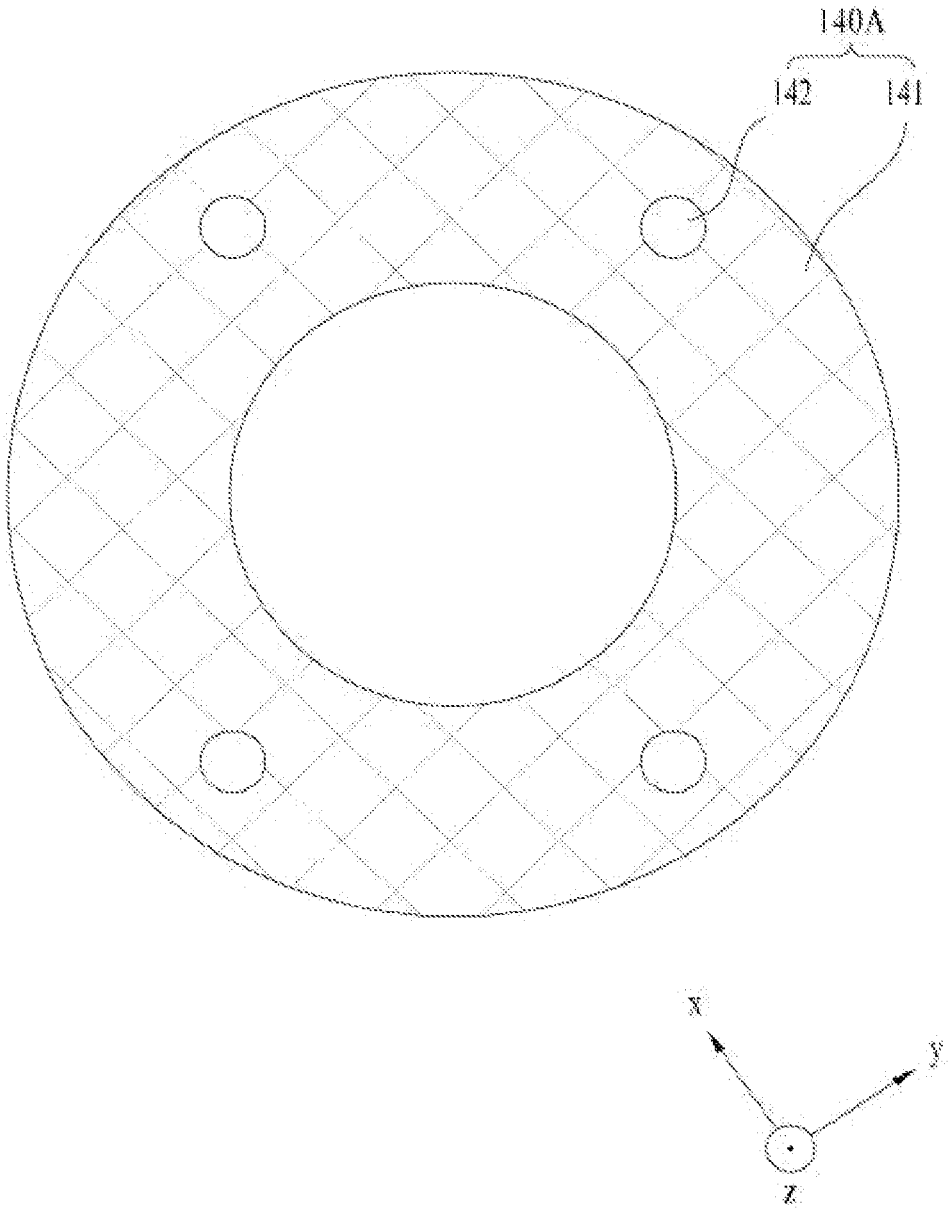
FIG. 2B is a plan view showing one embodiment of the slurry protection unit shown in FIG. 1.
Figure 3A:
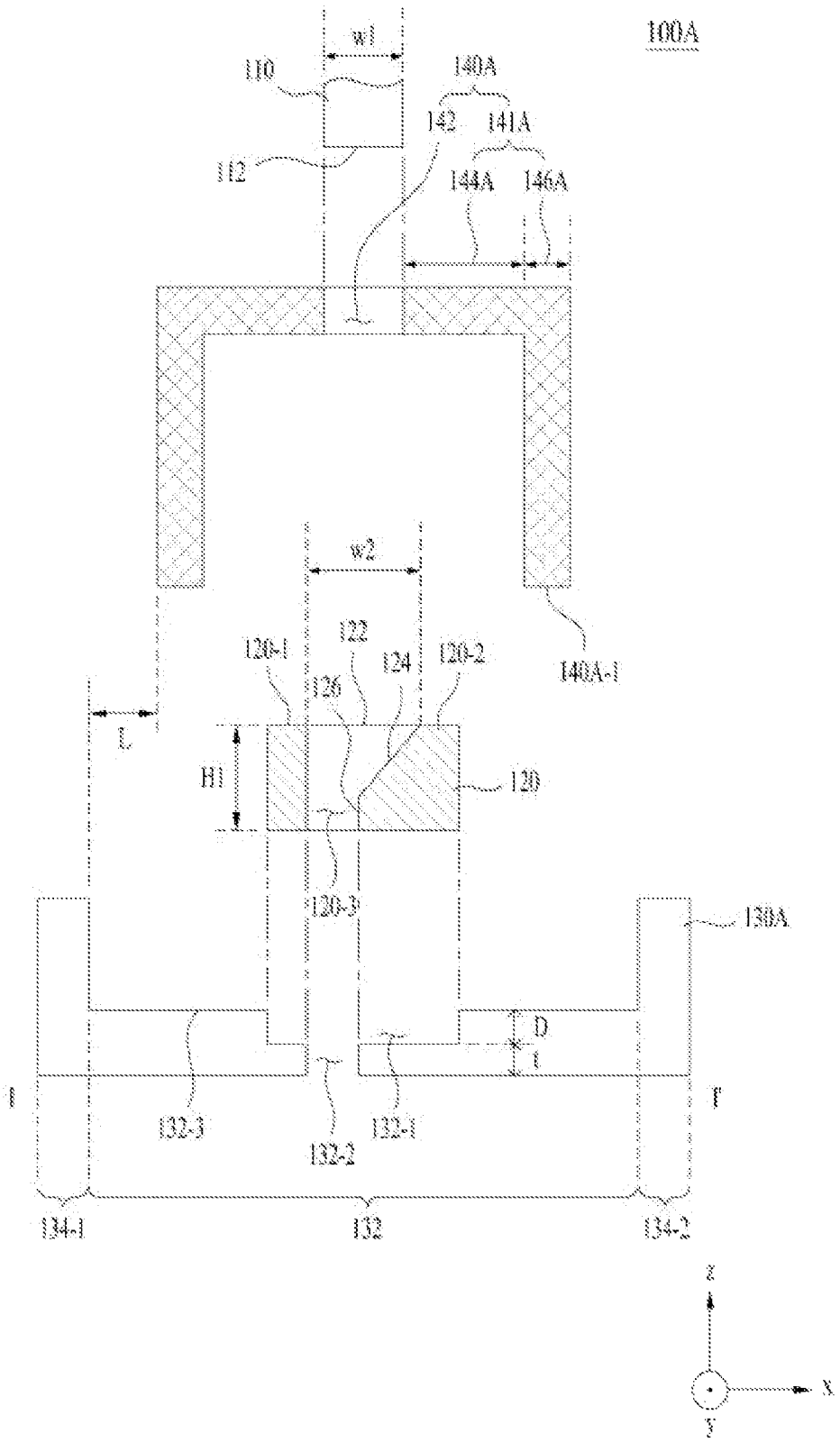
FIGS. 3A and 3B are respectively an exploded sectional view and an assembled sectional view taken along line I-I' of FIG. 1, showing the slurry supply device according to one embodiment.
Figure 3B:
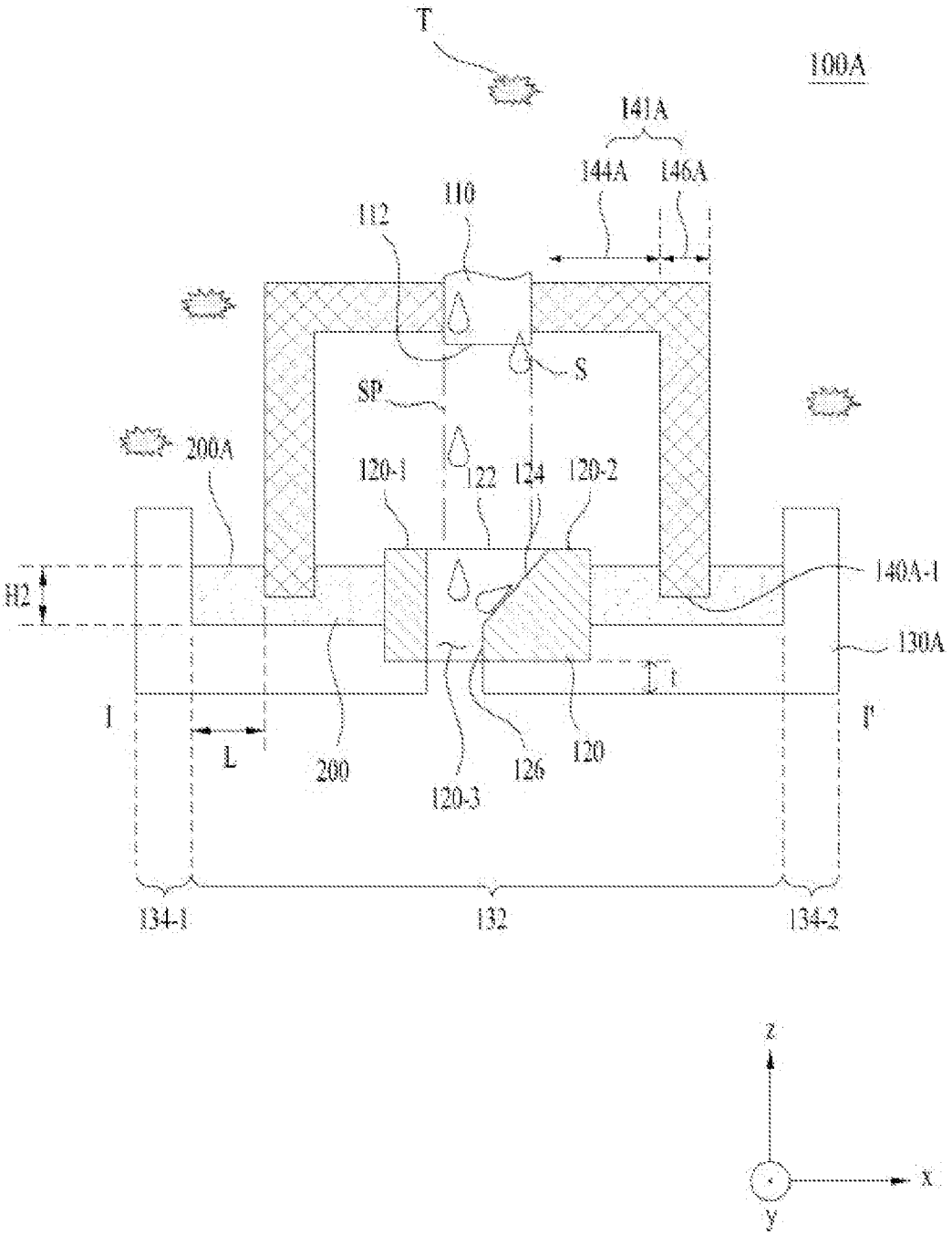

FIG. 1 is a plan view showing a slurry supply device 100 according to an embodiment, FIG. 2A is a plan view showing the slurry supply device 100 shown in FIG. 1 without a slurry protection unit 140, FIG. 2B is a plan view showing one embodiment 140A of the slurry protection unit 140 of the slurry supply device 100 shown in FIG. 1, FIG. 3A is an exploded sectional view taken along line I-I' of FIG. 1, showing a slurry supply device 100A according to one embodiment, and FIG. 3B is an assembled sectional view taken along line I-I' of FIG. 1, showing the slurry supply device 100A according to the embodiment.

Referring to FIGS. 1 to 3B, the slurry supply device 100: 100A according to the embodiment may include nozzles 110, a slurry supply unit 120, a receiving unit 130A and a supply protection unit 140: 140A.

The nozzles 110 serve to eject slurry S. For example, the nozzles 110, as exemplarily shown in FIGS. 1 and 2A, may be equidistantly arranged, although the embodiment is not limited to this arrangement shape of the nozzles 110.

In addition, while four nozzles 110 are shown in FIGS. 1 and 2A, the slurry supply device 100: 100A according to the embodiment may include more nozzles or fewer nozzles. That is, the slurry supply device 100: 100A according to the embodiment is not limited in terms of the number of the nozzles.

The slurry supply unit 120 serves to receive the slurry S from the nozzles 110 and discharge the slurry S through at least one slurry hole 120-3. Referring to FIG. 2A, the slurry supply device 100: 100A is shown as having sixteen slurry holes 120-3, although the embodiment is not limited thereto. That is, it will be appreciated that other embodiments in which more slurry holes 120-3 or fewer slurry holes 120-3 than the sixteen slurry holes 120-3 are provided are possible.

In addition, the slurry holes 120-3 may be arranged in a circumferential direction, and the slurry supply unit 120 may generally take the form of a disc provided with a protruded right-angled outer circumferential wall 120-1 and an inclined inner circumferential wall 120-2. In this case, the slurry holes 120-3 may be connectively formed in contact with an inner surface of the right-angled outer circumferential wall 120-1. Referring to FIGS. 3A and 3B, each nozzle 110 may be located between the right-angled outer circumferential wall 120-1 and the inclined inner circumferential wall 120-2 of the slurry supply unit 120. That is, an X-axis width w1 of the nozzle 110 may be less than an upper maximum X-axis distance w2 between the right-angled outer circumferential wall 120-1 and the inclined inner circumferential wall 120-2.

The slurry S may pass the inner surface of the right-angled outer circumferential wall 120-1 that is parallel to a slurry passage direction and the inner surface of the inclined inner circumferential wall 120-2 having an inclined inner surface 124 that is inclined relative to a slurry passage direction and, thereafter, be directed downward by a vertical guide surface 126 of the slurry supply unit 120.

The inclined inner surface 124 of the inclined inner circumferential wall 120-2 may be inclined on the basis of a slurry passage direction to allow the slurry S to be naturally directed downward by gravity.

In case that the slurry supply unit 120 is implemented as described above, the slurry S supplied from the nozzles 110 may be naturally discharged and guided outward through the slurry holes 120-3 by gravity, rather than remaining in the slurry supply unit 120. However, the embodiment is not limited to the above-described configuration of the slurry supply unit 120. That is, the slurry supply unit 120 may have different configurations than FIGS. 3A and 3B.

The receiving unit 130A is a unit in which the slurry supply unit 120 is mounted, inserted, seated, coupled, supported, or placed to allow the slurry S to be discharged from the slurry supply unit 120. In addition, the receiving unit 130A may be configured to receive a flowing material 200 around the slurry supply unit 120.

The receiving unit 130A may include at least one of a bottom portion 132 or first sidewall portions 134-1 and 134-2. The bottom portion 132 may have a supply unit receiving recess 132-1 and a through-hole 132-2. Here, the supply unit receiving recess 132-1 is a location where the slurry supply unit 120 is mounted, inserted, seated, coupled, supported or placed.

In the embodiment, a depth D of the supply unit receiving recess 132-1 may be less than a height difference ΔH from a first height H1 of the slurry supply unit 120 to a second height H2 of the flowing material 200. This serves to prevent the flowing material 200 from entering the slurry supply unit 120 because the greater depth D than the height difference ΔH causes a surface 200A of the flowing material 200 to be higher than an upper surface of the slurry supply unit 120.

In one embodiment, the slurry supply unit 120 may be mounted, inserted, seated, coupled, supported, or placed in the supply unit receiving recess 132-1. In this case, to prevent separation of the slurry supply unit 120 after the slurry supply unit 120 is mounted, inserted, seated, coupled, supported, or placed in the supply unit receiving recess 132-1, a bottom surface 132-3 of the bottom portion 132 may be stepped. In this case, a thickness t of the receiving unit 130A below the slurry supply unit 120 mounted, inserted, seated, coupled, supported, or placed in the supply unit receiving recess 132-1 may be above zero.

The slurry S discharged from the slurry holes 120-3 of the slurry supply unit 120 may be discharged outward of the slurry supply device 100: 100A through the through-hole 120-3.

Figure 4:
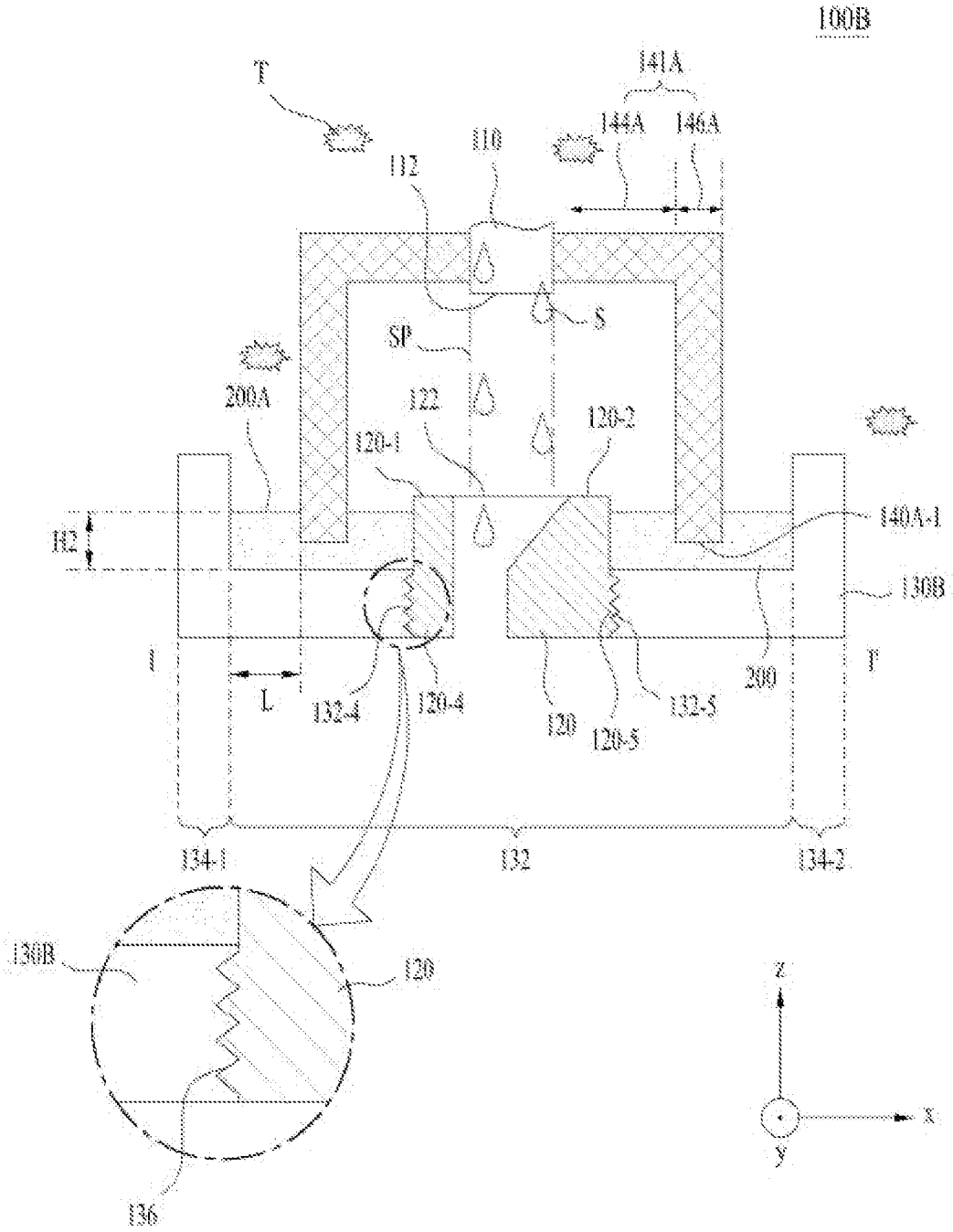
FIG. 4 is an assembled sectional view taken along line I-I' of FIG. 1, showing a slurry supply device according to still another embodiment.

FIG. 4 is an assembled sectional view taken along line I-I' of FIG. 1, showing a slurry supply device 100B according to another embodiment.

In the slurry supply device 100B exemplarily shown in FIG. 4, the slurry supply unit 120 may be screwed to a supply unit receiving unit 130B as represented by reference numeral 136. In this case, it is not necessary that the receiving unit 130B be located below the slurry supply unit 120. That is, a thickness t of the receiving unit 130B below the slurry supply unit 120 that is mounted, inserted, seated, coupled, supported, or placed in the supply unit receiving recess 132-1 may be zero. In the case of screwing 136 of the slurry supply unit 120 and the receiving unit 130B, the receiving unit 130B may have no through-hole 132-2 exemplarily shown in FIGS. 3A and 3B.

Referring to FIG. 4, one side surface 132-4 of the bottom portion 132 of the receiving unit 130B facing the slurry supply unit 120 may be provided with female threads (or male threads), and one side surface 120-4 of the slurry supply unit 120 facing the bottom portion 132 may be provided with male threads (or female threads) corresponding to the female threads (or the male threads). Through screwing of the male and female threads, the slurry supply unit 120 may be screwed to the receiving unit 130B.

For this screwing, for example, as exemplarily shown in FIG. 2A, the receiving unit 130B may be rotated in a counterclockwise direction A1 (or in a clockwise direction A2), and the slurry supply unit 120 may be rotated in a clockwise direction A2 (or in a counterclockwise direction A1).

Alternatively, differently from the illustration of FIG. 4, the other side surface 132-5 of the bottom portion 132 may be provided with female threads (or male threads), and the other side surface 120-5 of the slurry supply unit 120 may be provided with male threads (or female threads) corresponding to the female threads (or the male threads) such that the slurry supply unit 120 is screwed to the receiving unit 130B through screwing of the male and female threads.

As described above, except for screwing of the slurry supply unit 120 and the receiving unit 130B, the slurry supply device 100B shown in FIG. 4 is identical to the slurry supply device 100A shown in FIG. 3B and, thus, is designated by the same reference numerals and a repeated description of the same configuration will be omitted hereinafter.

In still another embodiment, the slurry supply unit 120 may be screwed to the receiving unit 130B as exemplarily shown in FIG. 4 under the condition that the thickness t is not zero as shown in FIG. 3B.

In addition, the first sidewall portions 134-1 and 134-2 of the receiving unit 130A may extend from the bottom portion 132 to define a space in which the flowing material 200 may be received. Referring to FIGS. 3A and 3B, the first sidewall portions 134-1 and 134-2 may extend from the bottom portion 132 in a thickness direction of the receiving unit 130A, i.e. in the Z-axis direction, although the embodiment is not limited thereto. That is, the first sidewall portions 134-1 and 134-2 may obliquely extend from the bottom portion 132 on the basis of the Z-axis, rather than extending in the Z-axis, so long as the first sidewall portions 134-1 and 134-2 define a space in which the flowing material 200 may be received.

Figure 5:
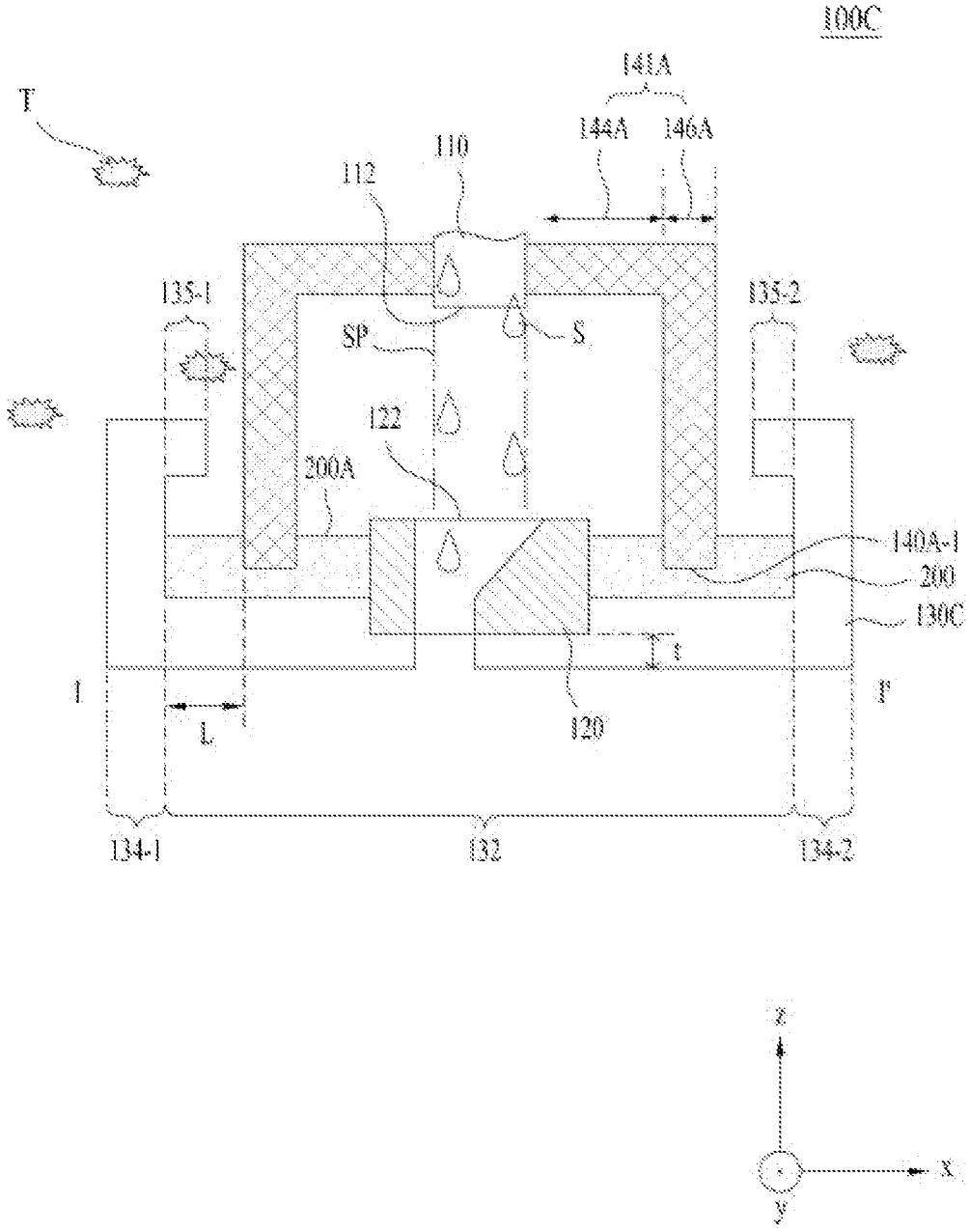
FIG. 5 is an assembled sectional view taken along line I-I' of FIG. 1, showing a slurry supply device according to still another embodiment.

FIG. 5 is an assembled sectional view taken along line I-I' of FIG. 1, showing a slurry supply device 100C according to still another embodiment.

Referring to FIG. 5, a receiving unit 130C may further include overflow prevention portions 135-1 and 135-2. Except for this, the slurry supply device 100C shown in FIG. 5 is identical to the slurry supply device 100A shown in FIG. 3 and, thus, is designated by the same reference numerals and a repeated description of the same configuration will be omitted hereinafter.

The overflow prevention portions 135-1 and 135-2 shown in FIG. 5 may inwardly protrude and extend from the first sidewall portions 134-1 and 134-2 of the receiving unit 130C so as to cover at least a portion of the surface 200A of the flowing material 200. Through the overflow prevention portions 135-1 and 135-2 of the receiving unit 130C, it is possible to prevent the flowing material 200 from overflowing the receiving unit 130C by centrifugal force during rotation of the receiving unit 130C.

Meanwhile, the slurry protection unit 140A may be configured to enclose a space SP, through which the slurry S passes from an exit 112 of each nozzle 110 to an entrance 122 of the slurry supply unit 120, in conjunction with the flowing material 200.

The slurry protection unit 140A may include nozzle receiving recesses 142 and a main cover 141A. Each of the nozzle receiving recesses 142 may be configured to face the entrance 122 of the slurry supply unit 120 and to allow the nozzle 110 to be mounted, inserted, seated, or coupled into the nozzle receiving recess 142.

The main cover 141A may be configured to hermetically seal the space SP for passage of the slurry S in conjunction with the flowing material 200.

Referring to FIGS. 3A, 3B, 4 and 5, the main cover 141A may include an upper end portion 144A and a second sidewall portion 146A extending from the upper end portion 144A.

In one embodiment, the upper end portion 144A may extend in a first direction and the second sidewall portion 146A may extend in a second direction. In this case, the second direction may be a discharge direction of the slurry S (in the Z-axis direction) and be perpendicular to the first direction. That is, the main cover 141A may have a cylindrical cross section.

Figure 6:
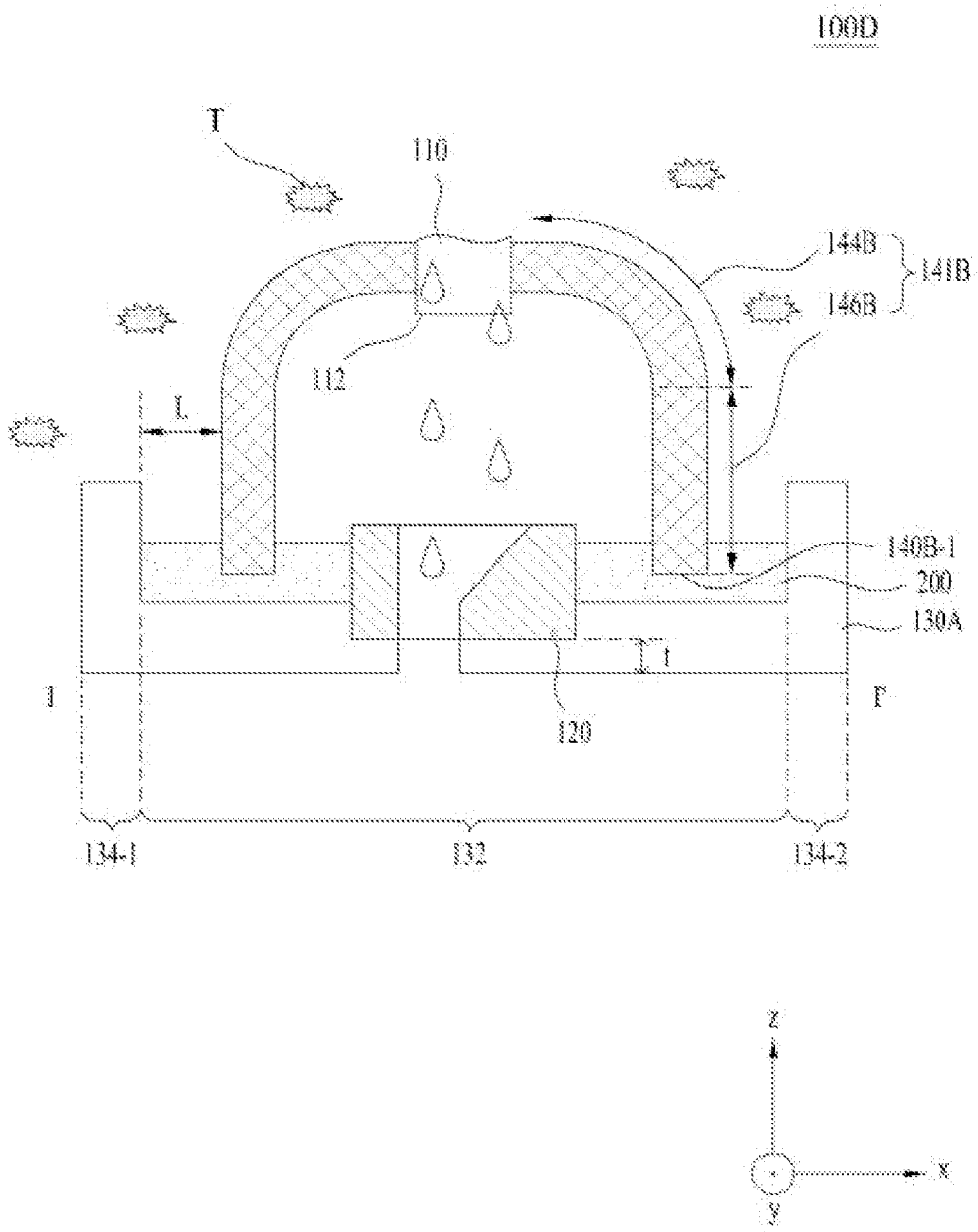
FIG. 6 is an assembled sectional view taken along line I-I' of FIG. 1, showing a slurry supply device according to still another embodiment.

FIG. 6 is an assembled sectional view taken along line I-I' of FIG. 1, showing a slurry supply device 100D according to still another embodiment.

As exemplarily shown in FIG. 6, an upper end portion 144B may have a first radius of curvature R1, whereas a second sidewall portion 146B may linearly extend from the upper end portion 144B in the second direction, i.e. in the Z-axis direction.

Alternatively, the upper end portion 144B of a main cover 141B may have the first radius of curvature R1 as exemplarily shown in FIG. 6, whereas the second sidewall portion 146B may have a second radius of curvature R2 differently from the illustration of FIG. 6.

In one embodiment, the first and second radii of curvature R1 and R2 may be the same. In this case, a slurry protection unit 140B may have a circular cross section. In another embodiment, the first and second radii of curvature R1 and R2 may be different.

Except for a difference in the shape of the slurry protection unit 140B, the slurry supply device 100D shown in FIG. 6 is identical to the slurry supply device 100A shown in FIG. 3B and, thus, is designated by the same reference numerals and a repeated description of the same configuration will be omitted hereinafter.

Figure 7:
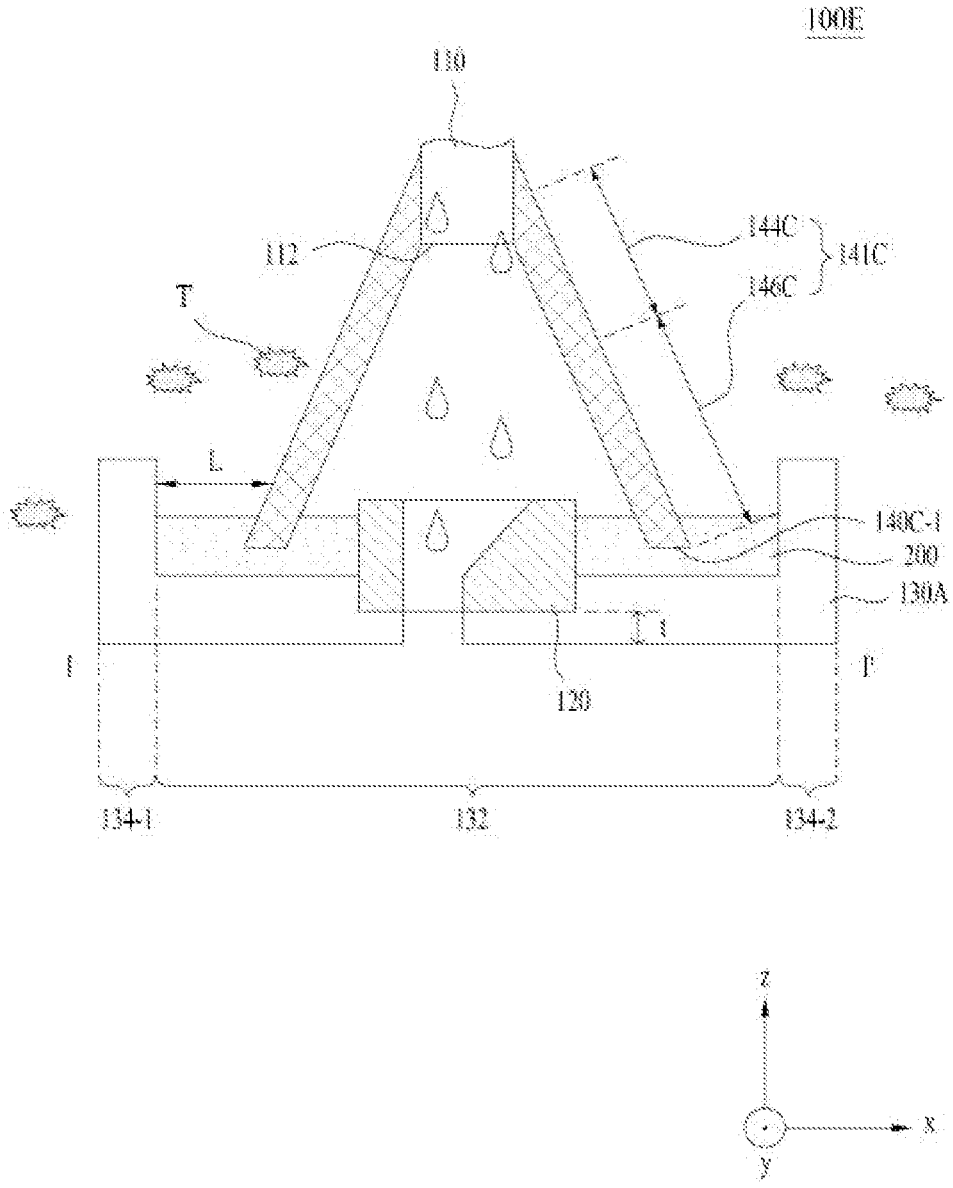
FIG. 7 is an assembled sectional view taken along line I-I' of FIG. 1, showing a slurry supply device according to still another embodiment.

FIG. 7 is an assembled sectional view taken along line I-I' of FIG. 1, showing a slurry supply device 100E according to still another embodiment.

Referring to FIG. 7, a main cover 141C may be tapered.

The main cover 141C may be divided into a tapered upper end portion 144C and a tapered second sidewall portion 146C. In this case, as exemplarily shown in FIG. 7, each of the upper end portion 144C and the second sidewall portion 146C may have the same taper angle and be integrally formed with each other. Alternatively, differently from the illustration of FIG. 7, the upper end portion 144C and the second sidewall portion 146C may have different taper angles, thus forming multiple stages that may be integrally formed with each other or may be separate from each other.

In addition, as exemplarily shown in FIG. 7, a taper angle of the upper end portion 144C and a taper angle of the second sidewall portion 146C may be the same.

In addition, the tapered upper end portion 144C and the tapered second sidewall portion 146 may be integrally formed with each other. In this case, the main cover 141C may have a conical cross section.

In addition, a taper angle of the upper end portion 144C and a taper angle of the second sidewall portion 146C may be different.

Except for a difference in the shape of the slurry protection unit 140C, the slurry supply device 100E shown in FIG. 7 is identical to the slurry supply device 100A shown in FIG. 3B and, thus, is designated by the same reference numerals and a repeated description of the same configuration will be omitted hereinafter.

Referring to FIGS. 3B to 7, an end 140A-1, 140B-1 or 140C-1 of the main cover 141A, 141B or 141C may be submerged in the flowing material 200. When the end 140A-1, 140B-1 or 140C-1 of the main cover 141A, 141B or 141C is submerged in the flowing material 200, the main cover 141A, 141B or 141C and the flowing material 200 may completely hermetically seal the space SP for passage of the slurry S.

When the space SP is completely hermetically sealed, there is no risk of contamination of the slurry S due to contaminants T, such as external dust or metal. This may prevent damage to a wafer, such as scratches, etc., and contamination of the wafer while the wafer is polished using the slurry S discharged from the slurry supply device 100: 100A, 100B, 100C, 100D or 100E as will be described below.

Figure 8:
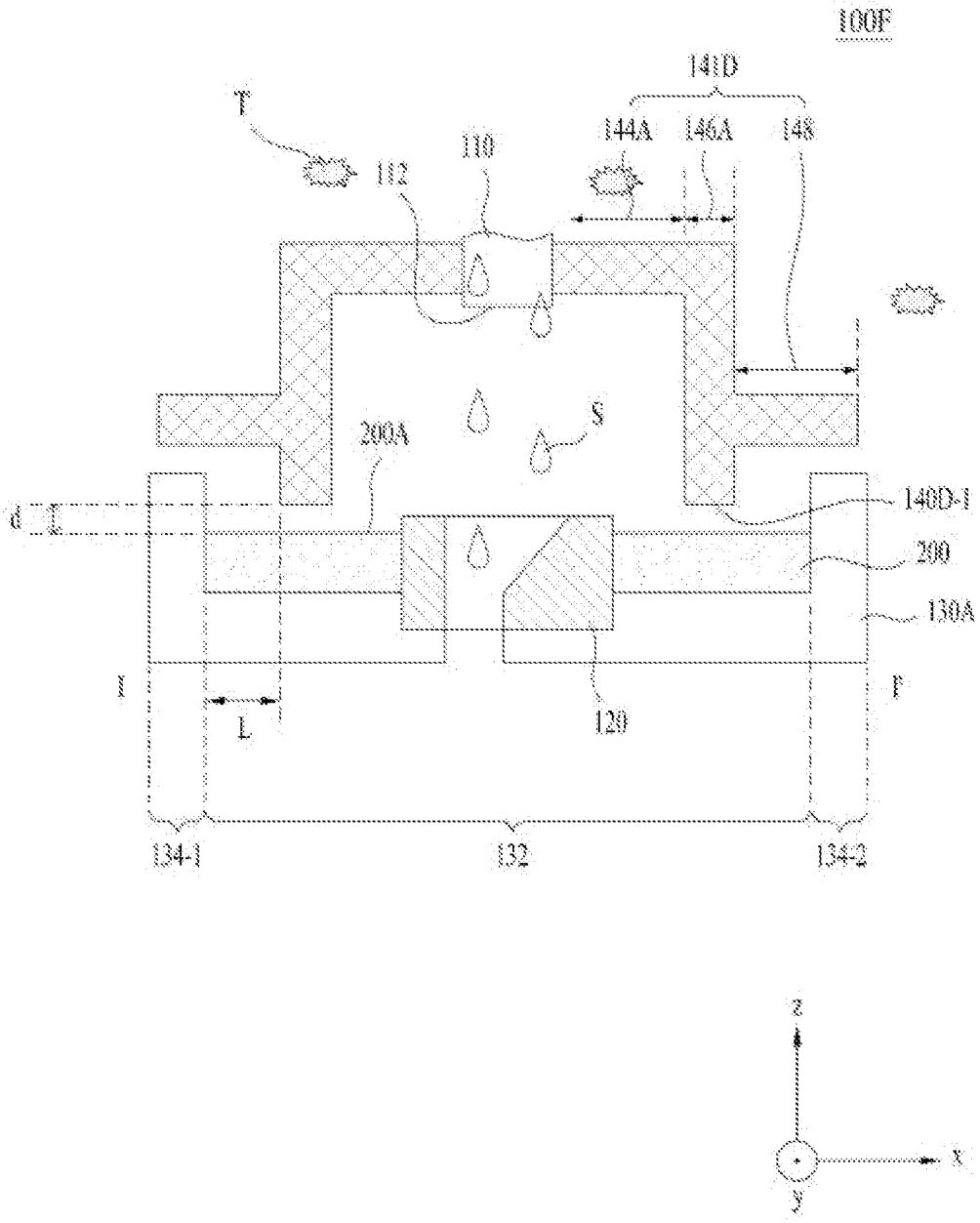
FIG. 8 is an assembled sectional view taken along line I-I' of FIG. 1, showing a slurry supply device according to still another embodiment.

FIG. 8 is an assembled sectional view taken along line I-I' of FIG. 1, showing a slurry supply device 100F according to still another embodiment.

As exemplarily shown in FIG. 8, an end 140D-1 of a main cover 141D may be spaced apart from the flowing material 200 by a prescribed distance d. In this case, the main cover 141D may include the upper end portion 144A and the second sidewall portion 146A and further include an auxiliary cover 148. Except for that the main cover 141D further includes the auxiliary cover 148 and the end 140D-1 of the main cover 141D is spaced apart from the flowing material 200, the slurry supply device 100F shown in FIG. 8 is identical to the slurry supply device 100A shown in FIG. 3B and, thus, is designated by the same reference numerals and a repeated description of the same configuration will be omitted hereinafter.

The auxiliary cover 148 may protrude from the second sidewall portion 146A in a first direction and placed to cover the top of the flowing material 200. When the flowing material 200 is covered with the auxiliary cover 148 so as not to be exposed, it is possible to prevent the space SP for passage of the slurry S from being contaminated by external contaminants T that fall by gravity in a second direction even if the end 140D-1 of the main cover 141D is not submerged by the flowing material 200 and the space SP is not completely hermetically sealed.

Meanwhile, when the slurry S is discharged outward from the slurry supply device 100: 100A, 100B, 100C, 100D, 100E or 100F, the nozzles 110 and the slurry protection unit 140A, 140B, 140C or 140D may be fixed without rotation, whereas the slurry supply unit 120 and the receiving unit 130A, 130B or 130C may be rotated. In this case, the second sidewall portion 146A, 146B or 146C may be spaced apart from the first sidewall portion 134-1 or 134-2 by a prescribed distance L. This serves to prevent the rotating receiving unit 130A, 130B or 130C from colliding with the fixed slurry protection unit 140A, 140B, 140C or 140D.

In addition, since the end 140A-1, 140B-1 or 140C-1 of the slurry protection unit 140A, 140B or 140C may be submerged in the flowing material 200 upon rotation of the slurry supply unit 120 and the receiving unit 130A, 130B or 130C, the flowing material 200 may be a fluid or colloidal gel. For example, the flowing material 200 may include ultra-pure water, although the embodiment is not limited in terms of the kind of the flowing material 200.

In some embodiments, the slurry supply unit 120, the slurry protection unit 140A, 140B, 140C or 140D, and the receiving unit 130A, 130B or 130C may respectively have the same plan shape. For example, referring to FIGS. 1, 2A and 2B, each of the slurry supply unit 120, the slurry protection unit 140A, and the receiving unit 130A may have an annular plan shape, although the embodiment is not limited to a specific plan shape of these components 120, 130A and 140A.

Figure 9:
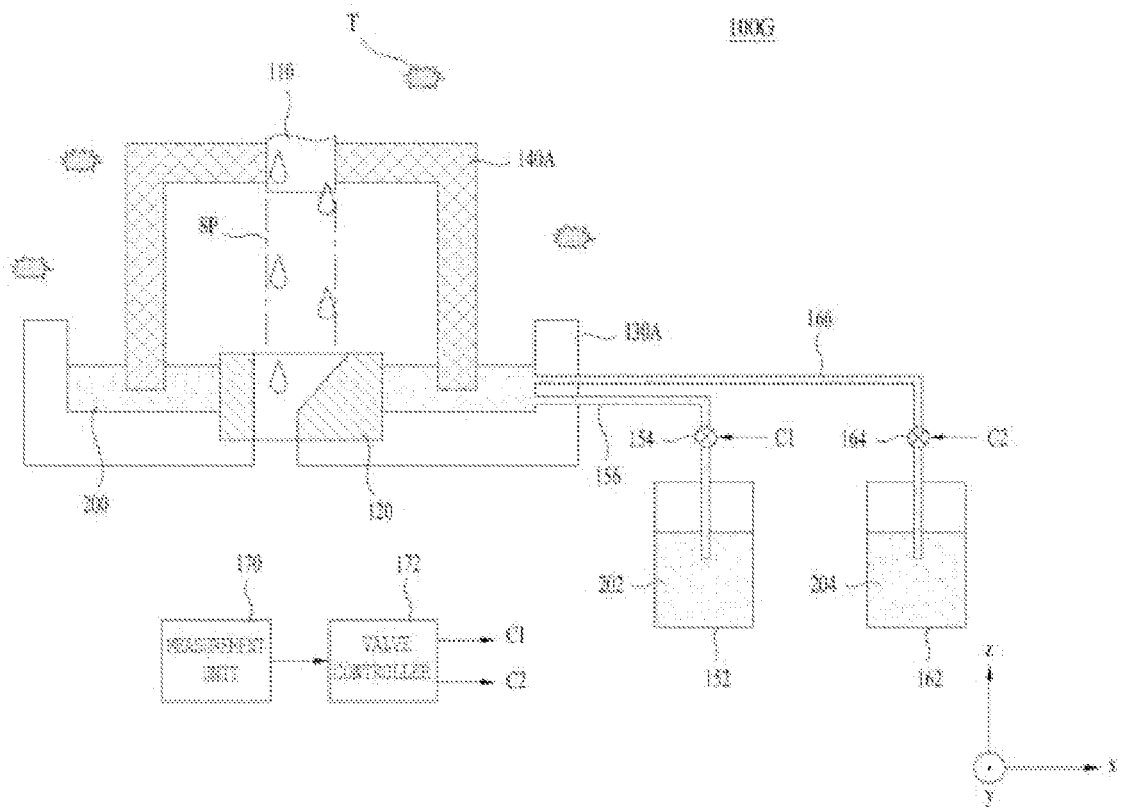
FIG. 9 is a view showing a slurry supply device according to still another embodiment.

FIG. 9 is a view showing a slurry supply device 100G according to still another embodiment.

The slurry supply device 100G exemplarily shown in FIG. 9 may include the nozzles 110, the slurry supply unit 120, the receiving unit 130A, the slurry protection unit 140A, first and second reservoirs 152 and 162, first and second pipes 156 and 166, first and second valves 154 and 164, a measurement unit 170, and a valve controller 172. Here, the nozzles 110, the slurry supply unit 120, the receiving unit 130A, and the slurry protection unit 140A respectively correspond to the nozzles 110, the slurry supply unit 120, the receiving unit 130A, and the slurry protection unit 140A shown in FIG. 3B and, thus, are designated by the same reference numerals and a repeated description thereof will be omitted hereinafter.

The first reservoir 152 may be used to store first fluid 202 and the second reservoir 162 may be used to store second fluid 204. The first and second fluids 202 and 204 may be the same or different.

In addition, the first reservoir 152 or the second reservoir 162 may be omitted.

In some embodiments, the first reservoir 152 may store the first fluid 202, i.e. supplement/replacement flowing material (hereinafter, referred to as supplement flowing material), and the second reservoir 162 may store the second fluid 204, i.e. washing solution.

The first pipe 156 may define a pathway through which the supplement flowing material 202 flows from the first reservoir 152 to the receiving unit 130A, and the second pipe 166 may define a pathway through which the washing solution 204 flows from the second reservoir 162 to the receiving unit 130A.

The measurement unit 170 may serve to measure the amount of the flowing material 200 received in the receiving unit 130A. The valve controller 172 may generate a first control signal C1 based on a received amount of the flowing material 200 measured by the measurement unit 170. In this case, the first valve 154 may adjust the amount of supplement flowing material 202 to be supplied from the first reservoir 152 to the receiving unit 130A in response to the first control signal C1 output from the valve controller 172.

Alternatively, instead of supplementing an insufficient amount of the flowing material 200 using the measurement unit 170 and the valve controller 172, in another embodiment, the flowing material 202 may be supplemented periodically and may be supplemented based on visual results.

In addition, the second valve 164 may adjust the amount of washing solution 204 to be supplied from the second reservoir 162 to the receiving unit 130A in response to a second control signal C2. The valve controller 172 may analyze, e.g., a used duration of the slurry supply device 100G and generate the second control signal C2 based on analyzed results.

The slurry supply device 100G as exemplarily shown in FIG. 9 may achieve efficient supplement of the flowing material 202 and have a self-washing function using the washing solution 204.

Hereinafter, a configuration and operation of a polishing apparatus including the slurry supply device according to any of the embodiments will be described with reference to the accompanying drawings.

Figure 10:
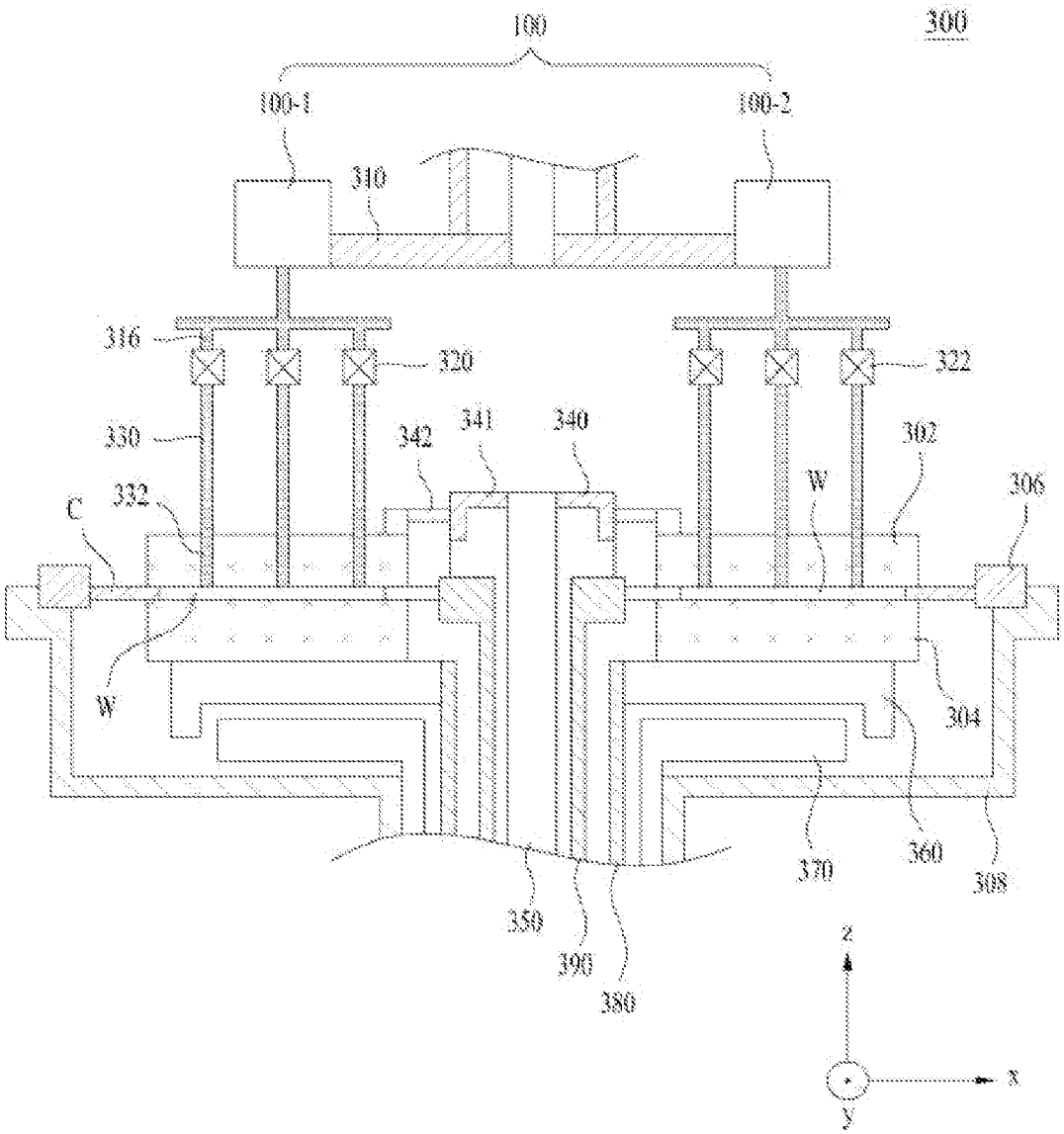
FIG. 10 is a view showing a polishing apparatus according to one embodiment.

FIG. 10 is a view showing a polishing apparatus 300 according to one embodiment.

The polishing apparatus 300 exemplarily shown in FIG. 10 may include carriers C, a slurry ring 100, an upper plate (or an upper polishing plate) 302 and a lower plate (or a lower polishing plate) 304 that are rotated in opposite directions, an internal gear 306, a casing 308, a plate 310, connection pipes 316, flow rate valves 320 and 322, connection tubes 330, slurry passage holes 332, a sun gear 340, engaging members 341 and 342, a drive shaft 350, a lower holder 360, a base 370, and first and second rotary shafts 380 and 390.

The carriers C may be located between the upper plate 302 and the lower plate 304, and may be provided at outer edges thereof with gears (not shown) to be engaged with the sun gear 340 and the internal gear 306. With this configuration, each carrier C may perform orbital movement along the internal gear 306 while rotating about an axis thereof.

As the upper plate 302 and the lower plate 304 are rotated, upper and lower surfaces of an object to be polished supported in a through-hole of each carrier C, for example, upper and lower surfaces of a wafer W may be polished by the upper plate 302 and the lower plate 304.

The lower plate 304 may be supported by the lower holder 360 and, in turn, the lower holder 360 may be rotatably supported by the base 370. The lower holder 360 may be rotated by the first rotary shaft 380, which may cause rotation of the lower plate 304. The upper plate 302 may be rotated by the drive shaft 350 and the engaging members 341 and 342. Here, the drive shaft 350 and the engaging members 341 and 342 correspond to a drive unit to rotate the upper plate 302. In addition, at least one of the first or second reservoirs 152 or 162 shown in FIG. 9 may be mounted, seated, placed, supported or coupled to the upper plate 302 so as to be rotated together.

The sun gear 340 may be rotated by the second rotary shaft 390. The casing 380 may support the internal gear 306. The plate 310 is disposed above the upper plate 302 and the slurry ring 100 is coupled to the plate 310. As the connection pipe 316 and the connection tube 330 are connected to the slurry ring 100, the slurry ring 100 is in communication with the slurry passage holes 332 formed in the upper plate 302. In addition, the flow rate valves 320 and 322 for control of a flow rate of slurry may be provided respectively at the connection tubes 330.

Here, slurry rings 100-1 and 100-2 may correspond respectively to the slurry supply device 100: 100A, 100B, 100C, 100D, 100E, 100F or 100G shown in FIGS. 1 to 9. That is, slurry discharged from the slurry supply device 100: 100A, 100B, 100C, 100D, 100E, 100F or 100G shown in FIGS. 1 to 9 may be supplied to the connection pipes 316. With this configuration, the slurry S supplied from the nozzles 110 may be supplied to a gap between the upper plate 302 and the lower plate 304 of the polishing apparatus 300 by passing through the slurry supply unit 120. The slurry holes 120-3 may in communication with the connection tubes 330 to guide the slurry S.

The plate 310 may be rotated in a given direction along with the upper plate 302, and slurry supplied into the slurry ring 100 may be supplied to the wafer W through the connection pipes 316, the connection tubes 330 and the slurry passage holes 332. The flow rate valves 320 and 322 may be used to adjust the amount of slurry to be supplied to the slurry passage holes 332.

The above-described polishing apparatus 300 shown in FIG. 10 may be used upon lapping or double side polishing of the wafer W.

Here, lapping refers to a process in which, after both sides of a wafer W having a difference in level are brought into close contact with facing surfaces of the upper plate 302 and the lower plate 304, slurry S containing an abrasive and a chemical material is injected into a gap between the upper plate 302 and the wafer W and a gap between the lower plate 304 and the wafer W to flatten the wafer W.

Double side polishing (DSP) refers to a process in which, after both sides of a wafer W having a difference in level are brought into close contact with pads (not shown) provided respectively at the upper plate 302 and the lower plate 304, slurry S containing an abrasive and a chemical material is injected into a gap between the wafer W and the polishing pads to flatten the surfaces of the wafer W.

As is apparent from the above description, slurry supply device and polishing apparatus including the same according to the embodiments may prevent slurry from being contaminated by contaminants, such as external dust or metal, which may prevent damage to wafers, such as scratches, and control contamination due to organic matter or metal during polishing of wafers. In addition, the slurry supply devices and the polishing apparatuses including the same according to the embodiments may prevent overflow of a flowing material due to centrifugal force upon rotation of a receiving unit, achieve supplement or replacement of the flowing material and have a self-washing function using a washing solution.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A slurry supply device, comprising:

a nozzle configured to eject slurry;

a slurry supply unit configured to receive the slurry from the nozzle and to discharge the slurry through at least one slurry hole;

a receiving unit configured to allow the slurry supply unit to be mounted, inserted, seated, coupled, supported, or placed therein so as to enable discharge of the slurry from the slurry supply unit, the receiving unit being configured to receive a flowing material around the slurry supply unit; and a slurry protection unit configured to enclose a space for passage of the slurry from an exit of the nozzle to an entrance of the slurry supply unit in conjunction with the flowing material.

2. The device according to claim 1, wherein the slurry protection unit includes:

a nozzle receiving recess arranged to face an entrance of the slurry supply unit, the nozzle receiving recess being configured to allow the nozzle to be mounted, seated, inserted, or coupled therein; and a main cover configured to hermetically seal the space for passage of the slurry in conjunction with the flowing material.

3. The device according to claim 2, wherein the main cover includes:

an upper end portion; and a first sidewall portion extending from the upper end portion.

4. The device according to claim 3, wherein the upper end portion extends in a first direction, the first sidewall portion extends in a second direction, and the second direction is a discharge direction of the slurry and is perpendicular to the first direction.

5. The device according to claim 3, wherein the upper end portion has a first radius of curvature and the first sidewall portion has a second radius of curvature.

6. The device according to claim 5, wherein the first and second radii of curvature are the same.

7. The device according to claim 5, wherein the first and second radii of curvature are different.

8. The device according to claim 3, wherein each of the upper end portion and the first sidewall portion are tapered and integrally formed with each other.

9. The device according to claim 2, wherein the main cover has an end submerged in the flowing material.

10. The device according to claim 4, wherein the main cover has an end spaced apart from the flowing material.

11. The device according to claim 10, wherein the main cover further includes an auxiliary cover protruding from the first sidewall portion in the first direction to cover the top of the flowing material.

12. The device according to claim 1, wherein the receiving unit includes:

a bottom portion; and a second sidewall portion extending from the bottom portion to define a space configured to receive the flowing material therein.

13. The device according to claim 12, wherein the bottom portion includes:

a supply unit receiving recess configured to allow the slurry supply unit to be mounted, inserted, seated, coupled, supported, or placed therein; and a through-hole for outflow of the slurry discharged from the slurry hole.

14. The device according to claim 12, wherein the receiving unit further includes an overflow prevention portion inwardly protruding and extending from the second sidewall portion of the receiving unit so as to cover at least a portion of a surface of the flowing material.

15. The device according to claim 1, further comprising:

a first reservoir configured to store a supplement flowing material; and a first pipe configured to define a pathway for passage of the supplement flowing material from the first reservoir to the receiving unit.

16. The device according to claim 15, further comprising:

a measurement unit configured to measure the amount of flowing material received in the receiving unit;

a valve controller configured to generate a control signal based on the received amount of flowing material; and a first valve configured to adjust the amount of supplement flowing material to be supplied from the first reservoir to the receiving unit in response to the control signal.

17. The device according to claim 1, further comprising:

a second reservoir configured to store washing solution; and a second pipe configured to define a pathway for passage of the washing solution from the second reservoir to the receiving unit.

18. The device according to claim 17, further comprising a second valve configured to adjust the amount of washing solution to be supplied from the second reservoir to the receiving unit.

19. A polishing apparatus, comprising:

an upper plate and a lower plate configured to polish an upper surface and a lower surface of an object to be polished;

a drive unit configured to rotate the upper plate; and the slurry supply device according to claim 1.

20. The apparatus according to claim 19, wherein at least one of the first reservoir or the second reservoir is mounted, seated, placed, supported or coupled to the upper plate so as to be rotated along with the upper plate.

* * * * *